US007004224B2

(12) United States Patent
Tsuzuki et al.

(10) Patent No.: US 7,004,224 B2
(45) Date of Patent: Feb. 28, 2006

(54) DIECASTING MACHINE

(75) Inventors: Naohiko Tsuzuki, Akashi (JP); Hideaki Harada, Kariya (JP); Hiromi Takagi, Kariya (JP); Hitoshi Oosawa, Kariya (JP)

(73) Assignees: Toyo Machinery and Metal Co., Ltd., Hyogo-Prep (JP); Denso Corporation, Aichi-Prep (JP)

( * ) Notice: Subject to any disclaimer, the term of this patent is extended or adjusted under 35 U.S.C. 154(b) by 0 days.

(21) Appl. No.: 10/712,928

(22) Filed: Nov. 13, 2003

(65) Prior Publication Data

US 2004/0099400 A1 May 27, 2004

(30) Foreign Application Priority Data

Nov. 22, 2002 (JP) ..... 2002-339870

(51) Int. Cl.
*B22D 17/10* (2006.01)
*B22D 17/32* (2006.01)

(52) U.S. Cl. ..... 164/312; 164/155.1

(58) Field of Classification Search ..... 164/312, 164/314, 315, 113, 151, 155.1, 155.3, 155.4, 164/154.2, 154.8

See application file for complete search history.

(56) References Cited

U.S. PATENT DOCUMENTS 4,044,653 A * 8/1977 Aoki ..... 91/392
5,365,999 A * 11/1994 Stummer et al. ..... 164/457
5,443,782 A * 8/1995 Nakamura et al. ..... 264/328.1
6,502,620 B1 * 1/2003 Jacobsen et al. ..... 164/18
6,629,558 B1 * 10/2003 Tsuji ..... 164/314

FOREIGN PATENT DOCUMENTS

JP 56-159136 12/1981
JP 10-202354 * 8/1998
JP 2000-33472 2/2000

* cited by examiner

*Primary Examiner*—Kevin P. Kerns
(74) *Attorney, Agent, or Firm*—Jordan and Hamburg LLP

(57) ABSTRACT

A diecasting machine capable of realizing highly precise injection of molten metal at high-speed without using an accumulator is provided, which includes: an injection cylinder for loading molten metal into a mold cavity by injection; a single two-way hydraulic pump driven by a driving motor for supplying hydraulic fluid to the injection cylinder in two directions; a hydraulic circuit for driving the injection cylinder by controlling supply of hydraulic fluid from the two-way hydraulic pump to the injection cylinder and discharge of hydraulic fluid from the injection cylinder which proceeds in accordance with movement of a piston of the injection cylinder; and a hydraulic controller for controlling rotational speed of the driving motor associated with the two-way hydraulic pump in injection/loading the molten metal and controlling torque of the driving motor in dwelling.

6 Claims, 3 Drawing Sheets

PRIOR ART

DIECASTING MACHINE

BACKGROUND OF THE INVENTION

1. Field of the Invention

The present invention relates to a diecasting machine utilizing a hybrid hydraulic circuit.

2. Description of the Related Art

A diecasting machine is an apparatus in which a piston of an injection cylinder is actuated by hydraulic pressure to inject and load molten metal fed to a molten metal loading sleeve into a clamped mold at high speed and, after dwelling/cooling is performed at high pressure, the mold is opened to remove the diecast product. In the high-speed injection/loading operation, a large amount of hydraulic fluid need be supplied quickly to the injection cylinder to move the piston at high speed. In the dwelling/cooling operation (particularly in the dwelling operation), high pressure is necessary for gradually supplying molten metal as the volume of the molten metal loaded in the mold decreases due to the cooling.

For this reason, as shown in FIG. 3, a typical prior-art diecasting machine B comprises a single hydraulic pump (not shown), a motor (not shown) for driving the pump, and an accumulator 53 for storing a large amount of hydraulic fluid under high pressure and for quickly supplying the hydraulic fluid to an injection cylinder 52 in injecting and loading molten metal at high speed.

However, the hydraulic circuit (not shown) using the accumulator 53 is extremely complicated and requires many hydraulic control valves (not shown) and long hydraulic fluid piping (not shown). Further, the amount of hydraulic fluid to be used and energy loss is large, and the injection accuracy is not satisfactory.

To solve such problems, a method of controlling diecast injection is proposed which does not employ such a hydraulic circuit but employs a ball thread driven and controlled by a servomotor (as disclosed in Patent Number JP10202354, which is hereinafter referred to as the first prior art method). In this first prior art method, since the injection pump is driven by a highly controllable electric servomotor, not by a hydraulic cylinder, the injection speed can be easily varied as desired depending on the configuration of the mold cavity. Further, the inclusion of air hardly occurs, and the surface rise in the cavity can be controlled with good repeatability.

Further, since the servo-control is employed, the completion of loading of molten metal into the mold cavity can be detected by the load torque applied to the servomotor. After the completion of loading is detected, control over the servomotor is switched from the rotational speed control to the torque control. In this state, the pressure can be set to a desired value with good repeatability, so that uniform and stable diecasting products can be produced. In this way, in this first prior art method, the injection speed and the injection pressure can be set as desired with better repeatability, as compared with hydraulic driving or pneumatic driving. Therefore, high-quality diecasting products with little difference in quality can be advantageously obtained.

However, the use of a ball thread as the driving source for injection makes is difficult to apply this method to a large diecasting machine.

In diecasting, a large amount of hydraulic fluid need be supplied to the injection cylinder in injecting molten metal, whereas not a large amount of hydraulic fluid supply but a high pressure is required in dwelling. Therefore, another prior art proposes that the speed control in injecting molten metal be switched to the pressure control in dwelling electrically using a single hydraulic control valve (as disclosed in Patent Number JP56159136, which is hereinafter referred to as the second prior art method). However, this second prior art method requires a complicated hydraulic control valve and also requires the use of a hydraulic pump capable of realizing the maximum discharge rate demanded by the diecasting machine. Therefore, a relatively large hydraulic pump need be used, hydraulic fluid to be used cannot be saved and energy loss occurs.

Still another prior art (disclosed in Patent Number JP2000033472, which is hereinafter referred to as the third prior art method) proposes a diecasting machine employing a flywheel with a clutch for saving energy. In this third prior art method, the flywheel is constantly rotated by an electric injection servomotor, and the clutch is connected at the timing of power supply in the high-speed injection operation and the pressurizing/dwelling operation. In this method, however, the flywheel need be constantly rotated at high speed even when the high-speed injection operation or the pressurizing/dwelling operation is not performed. Therefore, although a smaller electric servomotor for injection can be used, energy loss cannot be avoided. Moreover, this method requires a complicated mechanism such as a clutch as well as an electric control circuit.

SUMMARY OF THE INVENTION

The present invention has been conceived in view of the foregoing prior-art problems. Accordingly, it is an object of the present invention to realize highly precise injection of molten metal at high speed using a hydraulic circuit having a simple structure and without using an accumulator or any other complicated auxiliary devices.

In accordance with a first aspect of the present invention, there is provided a diecasting machine comprising:

an injection cylinder for loading molten metal into a mold cavity by injection;

a single two-way hydraulic pump driven by a driving motor for supplying hydraulic fluid to the injection cylinder in two directions;

a hydraulic circuit for driving the injection cylinder by controlling supply of hydraulic fluid from the two-way hydraulic pump to the injection cylinder and discharge of hydraulic fluid from the injection cylinder which proceeds in accordance with movement of a piston of the injection cylinder; and a hydraulic controller for controlling rotational speed of the driving motor associated with the two-way hydraulic pump in injection/loading the molten metal and controlling torque of the driving motor in dwelling.

In the diecasting machine of this construction using the single two-way hydraulic pump, the rotational speed of the driving motor associated with the two-way hydraulic pump is controlled in the injection/loading operation, while the torque of the driving motor of the two-way hydraulic pump is controlled in the dwelling/cooling operation (particularly in the dwelling operation). Therefore, unlike the prior art diecasting machine, the diecasting machine of the present invention does not need an accumulator. Further, the diecasting machine of the present invention can have piping of a very simplified structure, save hydraulic fluid to be used, and enhance the injection accuracy.

In accordance with another aspect of the present invention, there is provided a diecasting machine comprising:

an injection cylinder for loading molten metal into a mold cavity by injection;

a plurality of two-way hydraulic pumps connected in parallel with each other and driven by respective driving motors for supplying hydraulic fluid to the injection cylinder in two directions;

a hydraulic circuit for driving the injection cylinder by controlling supply of hydraulic fluid from the two-way hydraulic pumps to the injection cylinder and discharge of hydraulic fluid from the injection cylinder which proceeds in accordance with movement of a piston of the injection cylinder; and a hydraulic controller for actuating one of the two-way hydraulic pumps which is larger in capacity or both of the two-way hydraulic pumps in injection/loading the molten metal and actuating any one of the two-way hydraulic pumps or one of the two-way hydraulic pumps which is smaller in capacity in dwelling.

In the diecasting machine of this construction, both of the two-way hydraulic pumps are simultaneously actuated under rotational speed control or the two-way hydraulic pump having a larger capacity is actuated under control to supply a large amount of hydraulic fluid to the injection cylinder in injection/molding molten metal, thereby realizing injection/loading at high speed. On the other hand, in the dwelling/cooling operation (particularly in the dwelling operation) which requires little hydraulic fluid supply but calls for high pressure, either one of the two-way hydraulic pumps or the two-way hydraulic pump having a smaller capacity is actuated to supply only a required amount of hydraulic fluid as the need arises. Such a construction makes it possible to considerably simplify the hydraulic piping and reduce the energy loss.

In one embodiment, the two two-way hydraulic pumps are generally equal in capacity.

In another embodiment, one of the two-way hydraulic pumps which is driven in injection/loading the molten metal is larger in capacity than the other two-way hydraulic pump which is not driven in injection/loading the molten metal.

With the former embodiment, if a maximum discharge rate is necessary, both of the hydraulic pumps are actuated to deliver hydraulic fluid. Accordingly, the capacity of each hydraulic pump can be made smaller than in the case where a single two-way hydraulic pump is used. Thus, this embodiment is economical in this respect.

With the latter embodiment, one of the two-way hydraulic pumps which is smaller in capacity can be used in the dwelling/cooling operation (particularly in the dwelling operation) and, hence, the power consumption in the dwelling/cooling operation (particularly in the dwelling operation) can be reduced. Thus, this embodiment is economical in that respect.

In yet another embodiment, the hydraulic controller is operative to control a discharge rate of the two-way hydraulic pump or pumps based on hydraulic pressure information from a hydraulic fluid pipeline situated on a side toward which the piston is protruding.

This embodiment is capable of more precise torque control in dwelling/cooling (particularly in dwelling).

Preferably, the driving motor associated with the two-way hydraulic pump or with each of the two-way hydraulic pumps is a servomotor.

The use of such a servomotor as the driving motor makes it possible to feedback-control the rotational speed and the torque freely and accurately, so that the injection step, dwelling step and cooling step can be controlled highly accurately.

The foregoing and other objects, features and attendant advantages of the present invention will become apparent from the reading of the following detailed description in conjunction with the accompanying drawings.

DETAILED DESCRIPTION OF THE PREFERRED EMBODIMENTS

The present invention will now be described in detail by way of preferred embodiments thereof with reference to the accompanying drawings.

Figure 1:
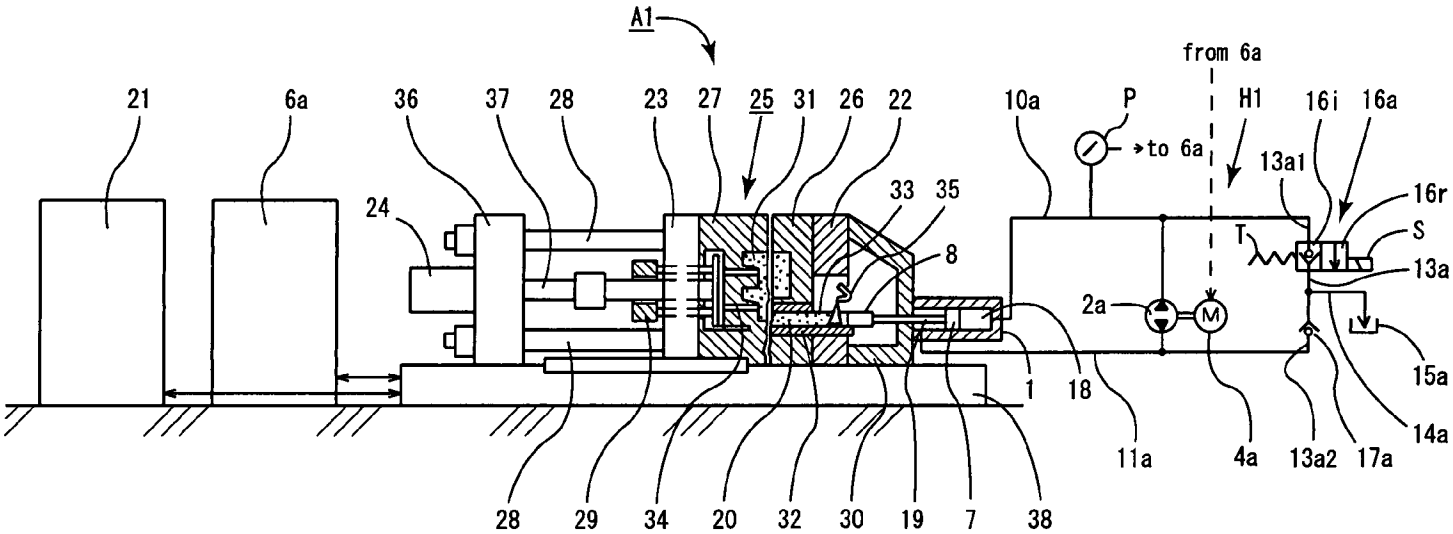
FIG. 1 is a partially sectional view illustrating a diecasting machine according to a first embodiment of the present invention.

Referring to FIG. 1, a diecasting machine A1 with a single two-way hydraulic pump 2*a* according to a first embodiment generally comprises a stationary platen 22 mounted on a machine base 38, a movable platen 23 disposed in facing relation to the stationary platen 22, a mount platen 36 to which a mold clamping cylinder 24 is mounted, a stationary mold member 26 and a movable mold member 27 respectively mounted to the stationary platen 22 and the movable platen 23, a tie bar 28 bridging between the stationary platen 22 and the mount platen 36 for guiding the sliding movement of the movable platen 23, an eject mechanism 29 for ejecting a diecast product out of the movable mold member 27 when the mold is opened, the above-described mold clamping cylinder 24, a frame 30 fitted on the stationary platen 22, a mold sleeve 32 mounted to the stationary platen 22 for loading molten metal 20 into a mold cavity 31, an injection cylinder 1 fitted in the frame 30, a hybrid hydraulic circuit H1 including the two-way hydraulic pump 2*a*, a driving motor 4*a* such as a servo motor for driving the two-way hydraulic pump 2*a* and the like, a hydraulic controller 6*a* for controlling the hybrid hydraulic circuit H1, and a machine controller 21.

The mold sleeve 32 is a cylindrical member, having a molten metal supply port 33 located in the stationary platen 22. The mold sleeve 32 is provided with a molten metal supply unit 35 for supplying molten metal 20 to the molten metal injection port 33. The injection cylinder 1 includes a piston 7 having a tip end provided with a plunger 8. The plunger 8 slides within the mold sleeve 32 to inject the molten metal 20 fed to the mold sleeve 32 into a mold cavity 31 of the mold 25 at high speed.

The mold 25, which consists of the stationary mold member 26 and the movable mold member 27, defines therein the mold cavity 31 having a predetermined configuration and communicating with the mold sleeve 32.

The mold clamping cylinder 24 includes a cylinder rod 37 fixed to the movable platen 23, so that the movable platen slides along the tie bar 28 in accordance with the operation of the mold clamping cylinder 24 to clamp and open/close the mold. The eject mechanism 29, which is mounted to the movable platen 23, includes eject pins 34 extending through the movable platen 23 to protrude into and retract from the mold cavity 31.

Next, the hybrid hydraulic circuit H1 will be described. The injection cylinder 1 defines therein a piston-protruding-side hydraulic fluid chamber 18 connected to a piston-protruding-side hydraulic fluid pipeline 10*a* for fluid communication and a piston-retracting-side hydraulic fluid chamber 19 connected to a piston-retracting-side hydraulic fluid pipeline 1*a* for fluid communication. The two-way hydraulic pump 2*a* interconnects the piston-protruding-side hydraulic fluid pipeline 10*a* and piston-retracting-side hydraulic fluid pipeline 11*a* for fluid communication.

The two-way hydraulic pump 2*a* is connected to the driving motor 4*a* which is servo-controlled so that hydraulic fluid of an optimum amount or pressure is supplied to the injection cylinder 1 in accordance with the sequence, whereby highly precise injection loading at high speed and dwelling/cooling can be realized. It is to be noted that the two-way hydraulic pump 2*a* can discharge hydraulic fluid in two directions, i.e. toward the piston-protruding-side hydraulic fluid pipeline 10*a* and toward the piston-retracting-side hydraulic fluid pipeline 11*a*.

The piston-protruding-side hydraulic fluid pipeline 10*a* and the piston-retracting-side hydraulic fluid pipeline 11*a* are connected to each other via a common pipeline 13*a* for fluid communication. The common pipeline 13*a* is connected to a tank pipeline 14*a* for returning hydraulic fluid to a hydraulic fluid tank 15*a* when the amount of hydraulic fluid in the common pipeline 13*a* is excessive and for sucking hydraulic fluid from the pressure tank 15*a* when the amount of hydraulic fluid in the common pipeline 13*a* is insufficient. The common pipeline 13*a* is provided with a check/one-way valve 16*a* at a portion 13*a*1 located adjacent the piston-protruding-side hydraulic fluid pipeline 10*a* and with a check valve 17*a* at a portion 13*a*2 located adjacent the piston-retracting-side hydraulic fluid pipeline 11*a* for preventing hydraulic fluid from returning toward the tank pipeline 14*a*.

The check/one-way valve 16*a* is provided with a solenoid S and a spring T, which act to switch the check/one-way valve 16*a* between a state which allows hydraulic fluid to be sucked from the hydraulic fluid tank 15*a* and fed to the piston-protruding-side hydraulic fluid chamber 18 (in which state hydraulic fluid does not flow reversely) and a state which allows hydraulic fluid discharged from the piston-protruding-side hydraulic fluid chamber 18 to be returned to the hydraulic fluid tank 15*a*. These states are indicated by reference signs 16*i* and 16*r*, respectively.

Between the injection cylinder 1 and the two-way hydraulic pump 2*a* is provided a pressure gauge P which constantly measures the pressure in the piston-protruding-side hydraulic fluid pipeline 10*a*. Based on the value of pressure thus measured, the driving motor 4*a* is servo-controlled by the controller 6*a*.

Next, description is directed to the operation of the present invention. Firstly, the mold clamping cylinder 24 is actuated to move the movable platen 23 to which the movable mold member 27 is mounted for clamping the mold. Subsequently, the driving motor 4*a* is actuated under rotational speed control for actuating the two-way hydraulic pump 2*a*. A large amount of hydraulic fluid discharged from the two-way hydraulic pump 2*a* in the forward direction flows into the piston-protruding-side hydraulic fluid chamber 18 of the injection cylinder 1 through the piston-protruding-side hydraulic fluid pipeline 10*a*, causing the piston 7 to protrude. At that time, hydraulic fluid partially flows toward the check/one-way valve 16*a* of the hydraulic fluid tank 15*a*. However, since the solenoid S of the check/one-way valve 16*a* is not actuated at this stage, hydraulic fluid is stopped at a check valve position 16*i* of the check/one-way valve 16*a* so as not to flow into the hydraulic fluid tank 15*a*. As a result, a large amount of the hydraulic fluid is pushed into the piston-protruding-side hydraulic fluid chamber 18.

In accordance with this operation, the piston 7 advances to push hydraulic fluid out of the piston-retracting-side hydraulic fluid chamber 19, and the hydraulic fluid thus discharged is wholly fed to the two-way hydraulic pump 2*a*. (Since the check valve 17*a* is provided adjacent the hydraulic fluid tank 15*a*, hydraulic fluid pushed out of the piston-retracting-side hydraulic fluid chamber 19 is stopped by the check valve 17*a* so as not to flow into the hydraulic fluid tank 15*a*.) Since the piston-protruding-side hydraulic fluid chamber 18 of injection cylinder 1 is larger in capacity than the piston-retracting-side hydraulic fluid chamber 19, hydraulic fluid lacks by as much as the difference of capacity even when the hydraulic fluid pushed out of the piston-retracting-side hydraulic fluid chamber 19 is wholly fed to the two-way hydraulic pump 2*a*. Therefore, the shortage is made up for by just a required amount of hydraulic fluid sucked from the hydraulic fluid tank 15*a* to the two-way hydraulic pump 2*a* through the check valve 17*a*.

As a result, a large amount of hydraulic fluid discharged under the rotational speed control as described before is pushed into the piston-protruding-side hydraulic fluid chamber 18, causing the piston 7 to protrude at high speed. As a result, the plunger 8 attached to the tip end of the piston 7 advances within the mold sleeve 32 at high speed, so that molten metal 20 in the mold sleeve 32 is loaded into the mold cavity 31 by injection. At that time, the driving motor 4*a* is servo-controlled (rotational speed control) by the hydraulic controller 6*a* so that the injection/loading of the molten metal can be performed at an optimum injection speed. At that time, the pressure gauge indicates a low value.

When the injection/loading of molten metal is completed, the process proceeds to the dwelling/cooling step. (In this case, the switching from the rotational speed control to the torque control is performed based on the value of pressure measured by the pressure gauge P.) Since not a large amount of hydraulic fluid but a high pressure is required in the dwelling step, control over the driving motor 4*a* of the two-way hydraulic pump 2*a* is switched from the rotational speed control to the torque control so that a predetermined torque is continuously applied, via the plunger 8, to the loaded metal which is being solidified. In this state, a small amount of molten metal 20 is supplied as the volume of the loaded molten metal in the mold cavity 31 decreases due to cooling, so that only a small amount of high-pressure hydraulic fluid is continuously supplied to the piston-protruding-side hydraulic fluid chamber 18.

In the subsequent cooling step, a gate portion communicating with the mold cavity 31 is closed due to solidification, so that little molten metal 20 is supplied. When the metal loaded in the mold cavity 31 is solidified after a certain period of time, the cooling step is finished. Thereafter, the mold clamping cylinder 24 is actuated to open the mold. At that time, the diecast product adhering to the movable mold member 27 is moved along with the movable mold member 27. Finally, the eject mechanism 29 is actuated to cause the eject pin 34 to protrude so that the solidified die cast product is released from the movable mold member 27 for collection. In the dwelling/cooling step (particularly in the dwelling step), the driving motor 4*a* for driving the two-way hydraulic pump 2*a* is servo-controlled so that an optimum pressure can be continuously applied to the metal loaded in the mold cavity 31.

On the other hand, when the cooling step is finished, the piston 7 is returned. Specifically, the driving motor 4*a* of the two-way hydraulic pump 2*a* performs the reverse action to cause hydraulic fluid to flow reversely to be fed to the piston-retracting-side hydraulic fluid chamber 19 through the piston-retracting-side hydraulic fluid pipeline 11*a*. In reaction thereto, the piston 7 moves in the returning direction while discharging hydraulic fluid to the piston-protruding-side hydraulic fluid pipeline 10*a*. At that time, the valve position of the check/one-way valve 16*a* has been switched into the one-way valve position 16*r* by the action of the solenoid S, so that most part of the hydraulic fluid discharged to the piston-protruding-side hydraulic fluid pipeline 10*a* is supplied to the two-way hydraulic pump 2*a*. Contrary to the above-described case, the amount of hydraulic fluid discharged to the piston-protruding-side pressure pipeline 10*a* is larger than that supplied to the piston-retracting-side hydraulic fluid chamber 19, so that the difference in fluid amount between the piston-retracting-side hydraulic fluid chamber 19 and the piston-protruding-side hydraulic fluid chamber 18 is returned to the hydraulic fluid tank 15*a* through the one-way valve position 16*r*.

Although part of the hydraulic fluid discharged from the two-way hydraulic pump 2*a* to the piston-retracting-side hydraulic fluid pipeline 11*a* flows toward the hydraulic fluid tank 15*a*, the check valve 17*a* blocks this flow (or hydraulic fluid sucked from the hydraulic fluid tank 15*a* pushes back the flow) and prevents this part of the hydraulic fluid from flowing into the hydraulic fluid tank 15*a*. In this way, diecasting is performed using the sole two-way hydraulic pump 2*a*.

Figure 2:
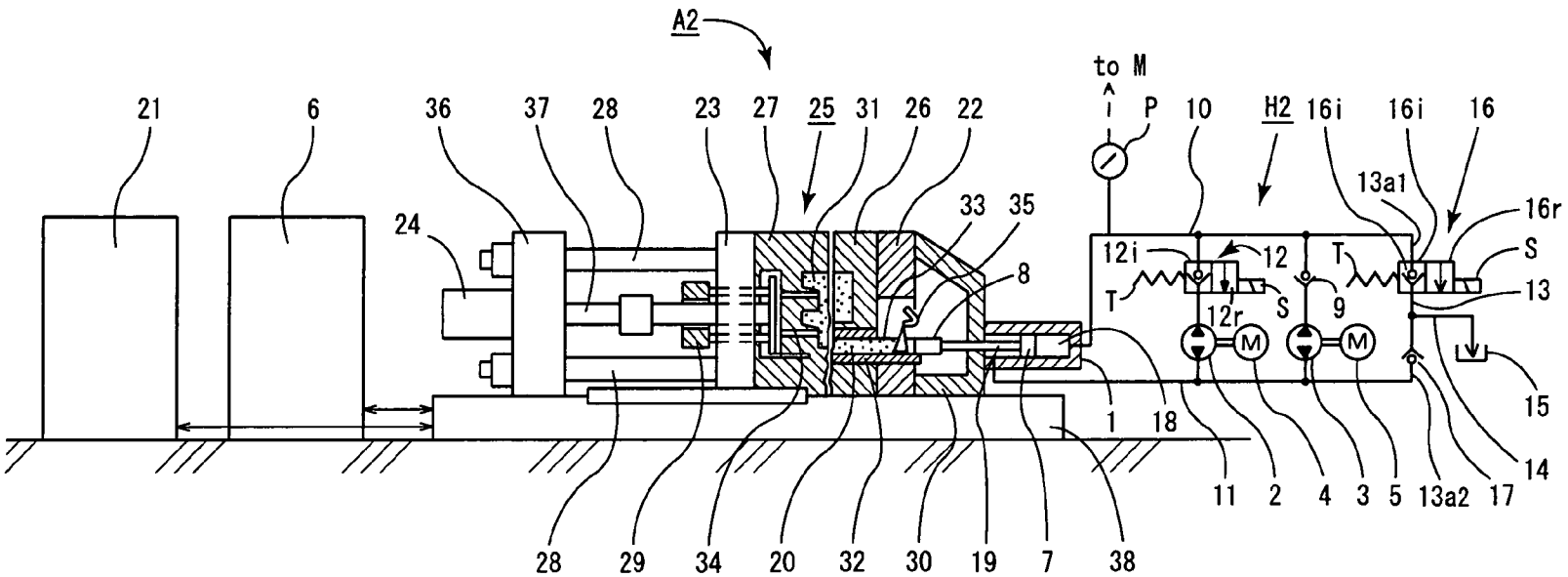
FIG. 2 is a partially sectional view illustrating a diecasting machine according to a second embodiment of the present invention.
Figure 3:
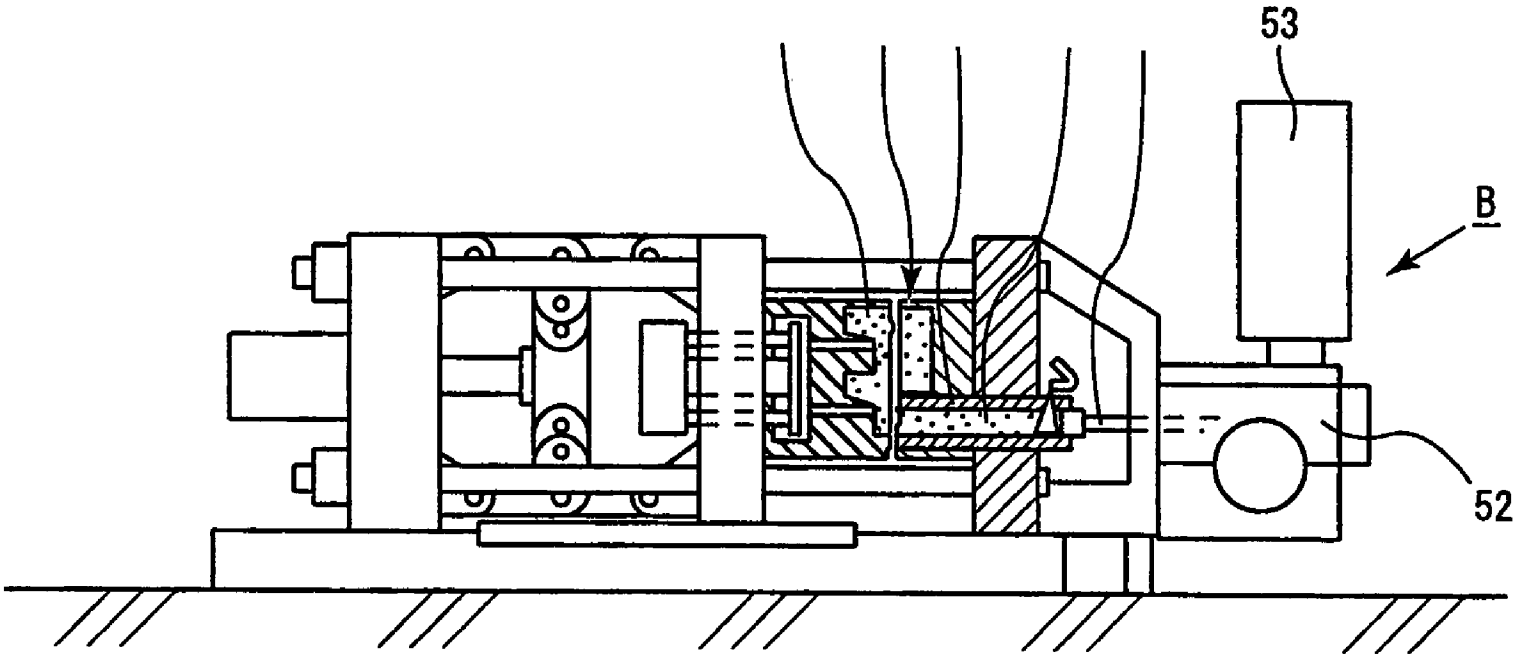
FIG. 3 is a partially sectional view illustrating a prior art diecasting machine.

Next, with reference to FIG. 2, description will be made of a second embodiment A2 employing two two-way hydraulic pumps 2 and 3. For easy description, features which are different from those of the first embodiment will be described mainly.

The construction of the second embodiment A2 is generally identical to that of the first embodiment A1 but slightly differs in the structure of the hybrid hydraulic circuit H2 because of the use of two two-way hydraulic pumps. The two two-way hydraulic pumps to be used have their respective capacities which may be equal to or different from each other. Description is first directed to the case where the pumps have different capacities.

In the hybrid hydraulic circuit H2 of the second embodiment A2, an injection cylinder 1 defines therein a piston-protruding-side hydraulic fluid chamber 18 connected to a piston-protruding-side hydraulic fluid pipeline 10 for fluid communication, and a piston-retracting-side hydraulic fluid chamber 19 connected to a piston-retracting-side hydraulic fluid pipeline 11 for fluid communication. Between the piston-protruding-side hydraulic fluid pipeline 10 and the piston-retracting-side hydraulic fluid pipeline 11 are provided a larger-capacity two-way hydraulic pump 2 and a smaller-capacity two-way hydraulic pump 3, which are connected in parallel. In this embodiment, the larger-capacity two-way hydraulic pump 2 for high-speed injection is disposed on the side closer to injection cylinder 1, whereas the smaller-capacity two-way hydraulic pump 3 is disposed on the side away from the injection cylinder 1. Between the larger-capacity two-way hydraulic pump 2 and the piston-protruding-side hydraulic fluid pipeline 10 is disposed a check/one-way valve 12.

The check/one-way valve 12 (as well as the check/one-way valve 16 which will be described later) assumes a check valve position 12*i* (16*i* in the case of the check/one-way valve 16) when the solenoid S is not actuated while the spring T is acting. In this state, hydraulic fluid flowing in the forward direction (i.e. from the larger-capacity two-way hydraulic pump 2 toward the piston-protruding-side hydraulic fluid pipeline 10 or from hydraulic fluid tank 15 toward the piston-protruding-side hydraulic fluid pipeline 10 in this case) is allowed to pass through the check/one-way valve 12, but hydraulic fluid flowing in the reverse direction (i.e. from the piston-protruding-side hydraulic fluid pipeline 10 toward the larger-capacity two-way hydraulic pump 2 or from the piston-protruding-side hydraulic fluid pipeline 10 toward the hydraulic fluid tank 15) is prevented from passing through the check/one-way valve 12. When the solenoid S is actuated to switch the valve 12 into a one-way valve position 12*r* (16*r* in the case of the check/one-way valve 16), hydraulic fluid flowing from the side opposite to the check valve position 12*i* (or 16*i*) (i.e. from the piston-protruding-side hydraulic fluid pipeline 10 toward the larger-capacity two-way hydraulic pump 2 or toward the hydraulic fluid tank 15) is allowed to pass through the check/one-way valve 12.

Between the smaller-capacity two-way hydraulic pump 3 and the piston-protruding-side hydraulic fluid pipeline 10 is provided a check valve 9 which allows forward flow of hydraulic fluid from the smaller-capacity two-way hydraulic pump 3 to the piston-protruding-side hydraulic fluid pipeline 10 but blocks reverse flow of the hydraulic fluid from the piston-protruding-side hydraulic fluid pipeline 10 to the smaller-capacity two-way hydraulic pump 3.

The two-way hydraulic pumps 2 and 3 are respectively connected to the driving motors 4 and 5 which are servo-controlled so that hydraulic fluid of an optimum amount or pressure is supplied to the injection cylinder 1 in accordance with the sequence, whereby highly precise injection/loading at high speed (under rotational speed control) and dwelling (under torque control) can be realized. It is to be noted that the two-way hydraulic pumps 2 and 3 can discharge hydraulic fluid in two directions, i.e. toward the piston-protruding-side hydraulic fluid pipeline 10 and toward the piston-retracting-side hydraulic fluid pipeline 11, similarly as in the first embodiment.

The piston-protruding-side hydraulic fluid pipeline 10 and the piston-retracting-side hydraulic fluid pipeline 11 are connected to each other via a common pipeline 13 for fluid communication. The common pipeline 13 is connected to a tank pipeline 14 for returning hydraulic fluid to the hydraulic fluid tank 15 when the amount of hydraulic fluid in the common pipeline 13 is excessive and for sucking hydraulic fluid from the pressure tank 15 when the amount of hydraulic fluid in the common pipeline 13 is insufficient. The common pipeline 13 is provided with a check/one-way valve 16 at a portion 13*a*1 located adjacent the piston-protruding-side hydraulic fluid pipeline 10 and between the tank pipeline 14 and the piston-protruding-side hydraulic fluid pipeline 10 and with a check valve 17 at a portion 13*a*2 located adjacent the piston-retracting-side hydraulic fluid pipeline 11 for preventing hydraulic fluid from returning toward the tank pipeline 14.

Similarly to the first embodiment, between the injection cylinder 1 and the larger-capacity two-way hydraulic pump 2 is provided a pressure gauge P which constantly measures the pressure in the piston-protruding-side hydraulic fluid pipeline 10. Based on the value of pressure thus measured, the hydraulic controller 6 servo-controls the switching between the driving motors 4 and 5, rotational speed control and torque control.

The operation of the second embodiment A2 is as follows. Firstly, the mold clamping cylinder 24 is actuated to move the movable platen 23 mounting the movable mold member 27 to clamp the mold. Then, the driving motor 4 is actuated under rotational speed control (because a large amount of hydraulic fluid need be discharged) to actuate the larger-capacity two-way hydraulic pump 2. Hydraulic fluid discharged from the larger-capacity two-way hydraulic pump 2 in the forward direction flows through the check valve position 12*i* into the piston-protruding-side hydraulic fluid chamber 18 of the injection cylinder 1 to cause the piston 7 to protrude. At that time, part of the hydraulic fluid flows toward the check/one-way valve 16 on the hydraulic fluid tank 15 side. However, since the solenoid S of the check/one-way valve 16 is not actuated at this stage, the hydraulic fluid is stopped at the check valve position 16*i* of the check/one-way valve 16 so as not to flow into the hydraulic fluid tank 15. (Conversely, hydraulic fluid sucked from the hydraulic fluid tank 15 flows through the check valve position 16*i* in the forward direction, as will be described later.) Similarly, although part of the hydraulic fluid flows in the reverse direction toward the smaller-capacity two-way hydraulic pump 3, the check valve 9 blocks the hydraulic fluid so as not to flow into the smaller-capacity two-way hydraulic pump 3. As a result, the hydraulic fluid is wholly supplied to the piston-protruding-side hydraulic fluid chamber 18.

In accordance with this operation, the piston 7 advances to push hydraulic fluid out of the piston-retracting-side hydraulic fluid chamber 19, and the hydraulic fluid thus pushed out is wholly supplied to the larger-capacity two-way hydraulic pump 2. As in the first embodiment, the piston-protruding-side hydraulic fluid chamber 18 of the injection cylinder 1 is larger in capacity than the piston-retracting-side hydraulic fluid chamber 19. Therefore, the shortage is made up for by just a required amount of hydraulic fluid sucked from the hydraulic fluid tank 15 through the check valve 17 for supply to the larger-amount two-way hydraulic pump 2.

As a result, a large amount of hydraulic fluid flows into the piston-protruding-side hydraulic fluid chamber 18, causing the piston 7 to protrude at high speed. Thus, the plunger 8 attached to the tip end of the piston 7 advances within the mold sleeve 32 at high speed so that molten metal 20 in the mold sleeve 32 is loaded into the mold cavity 31 by injection. At that time, the pressure gauge P measures the pressure in the piston-protruding-side hydraulic fluid pipeline 10. Based on the value of pressure thus measured, the hydraulic controller 6 servo-controls the rotational speed of the driving motor 4 of the larger-capacity two-way hydraulic pump 2 so that the injection/loading can be performed at an optimum injection speed.

When the injection/loading is completed, the process proceeds to the dwelling/cooling step. Since not a large amount of hydraulic fluid but a high pressure is required in the dwelling step, the operation of the larger-capacity two-way hydraulic pump 2 is stopped while the smaller-capacity two-way hydraulic pump 3 is actuated. (This switching is performed based on the value of pressure measured by the pressure gauge P. Specifically, when the pressure exceeds a predetermined value, it is determined that the process proceeds to the dwelling/cooling step.) By the switching, the driving motor 4 of the larger-capacity two-way hydraulic pump 2 is stopped, whereas the driving motor 5 is actuated under torque control to cause the smaller-capacity two-way hydraulic pump 3 to discharge a small amount of high-pressure hydraulic fluid for supply to the piston-protruding-side hydraulic fluid chamber 18. Thus, while maintaining the high-pressure state, a small amount of molten metal 20 is supplied as the volume of the loaded molten metal in the mold cavity 31 decreases due to cooling. When the loaded molten metal 20 at the gate portion is solidified to close the gate portion, the dwelling step is finished to proceed to the cooling step.

When the molten metal loaded in the mold cavity 31 is solidified to such a degree as not to be deformed even when released from the mold cavity 31, the cooling step is finished. Thereafter, the mold clamping cylinder 24 is actuated to open the mold. In opening the mold, the solidified diecast product adhering to the movable mold member 27 moves together with movable the mold member 27. Finally, the eject mechanism 29 is actuated to cause the eject pin 34 to protrude so that the solidified diecast product is released from the movable mold member 27 for collection. In the above-described dwelling/cooling step (particularly in the dwelling step), the torque of the driving motor 5 driving the smaller-capacity hydraulic pump 3 is servo-controlled so that an optimum pressure is continuously applied to the metal loaded in the mold cavity 31. The servo-control of the torque is performed based on the value of pressure measured by the pressure gauge P.

On the other hand, when the cooling step is finished, the piston 7 is returned. Specifically, the smaller-capacity two-way hydraulic pump 3 is stopped, whereas the larger-capacity two-way hydraulic pump 2 is actuated to supply hydraulic fluid to the piston-retracting-side hydraulic fluid chamber 19 through the piston-retracting-side hydraulic fluid pipeline 11. In reaction thereto, the piston 7 moves in the returning direction so that hydraulic fluid is discharged to the piston-protruding-side hydraulic fluid pipeline 10. At that time, by the action of the solenoids S, the positions of the check/one-way valves 12 and 16 have been switched into their respective one-way valve positions 12*r* and 16*r*. Therefore, most part of the hydraulic fluid discharged to the piston-protruding-side hydraulic fluid pipeline 10 is supplied to the larger-capacity two-way hydraulic pump 2 through the one-way valve position 12*r*, while at the same time, the difference in fluid amount between the piston-retracting-side hydraulic fluid chamber 19 and the piston-protruding-side hydraulic fluid chamber 18 is returned to the hydraulic fluid tank 15 through the one-way valve position 16*r*.

Although part of the hydraulic fluid discharged from the larger-capacity two-way hydraulic pump 2 to the piston-retracting-side hydraulic fluid pipeline 11 flows toward the hydraulic fluid tank 15, the check valve 17 blocks this flow and prevents this part of the hydraulic fluid from flowing into the hydraulic fluid tank 15. Further, since the smaller-capacity two-way hydraulic pump 3 is stopped, hydraulic fluid does not flow through.

In the above-described high-speed injection/loading operation, both of the driving motors 4 and 5 may be actuated to actuate the larger-capacity two-way hydraulic pump 2 and the smaller-capacity two-way hydraulic pump 3 so that a much larger amount of hydraulic fluid is discharged from the larger-capacity two-way hydraulic pump 2 and the smaller-capacity two-way hydraulic pump 3. In this case, the maximum discharge rate is the sum of the discharge rate of the larger-capacity two-way hydraulic pump 2 and that of the smaller-capacity two-way hydraulic pump 3. Therefore, the capacity of the larger-capacity two-way hydraulic pump 2 can be reduced by a value as large as the capacity of the smaller-capacity two-way hydraulic pump 3. In the dwelling/cooling step, only the smaller-capacity two-way hydraulic pump 3 is actuated. Further, in the above-described case, the two-way hydraulic pumps 2 and 3 may have equal capacity.

As has been described above, the diecasting machine using a single two-way hydraulic pump according to the present invention is constructed such that the rotational speed of the driving motor associated with the two-way hydraulic pump is controlled in the high-speed injection/loading operation, whereas the torque of the driving motor is controlled in the dwelling operation. Therefore, unlike the prior art, the diecasting machine does not need an accumulator. Therefore, the diecasting machine can have piping of a very simplified structure, save hydraulic fluid to be used, and enhance the injection accuracy.

The diecasting machine using a plurality of (two) two-way hydraulic pumps according to the present invention is capable of actuating both of the hydraulic pumps simultaneously under rotational speed control to discharge a large amount of hydraulic fluid or actuating only the larger-capacity hydraulic pump to supply a required amount of hydraulic fluid in the high-speed molten metal injection/loading operation. In dwelling/cooling operation, either one of the two-way hydraulic pumps or the smaller-capacity two-way hydraulic pump is operated under torque control to continuously apply a necessary pressure to the loaded metal. Also in this case, such an accumulator as required in the prior art is unnecessary. Therefore, the diecasting machine can have piping of a very simplified structure, save hydraulic fluid to be used, and enhance the injection accuracy. Further, since the two-way hydraulic pump used in the dwelling/cooling operation has a smaller capacity than the other, the diecasting machine can save energy accordingly and realize considerable energy loss reduction.

Moreover, the use of a servomotor as the driving motor for each two-way hydraulic pump makes it possible to feedback-control the rotational speed and the torque freely and accurately, so that the injection step, dwelling step and cooling step can be controlled highly accurately.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A diecasting machine comprising:

an injection cylinder for loading molten metal into a mold cavity by injection;

a single two-way hydraulic pump driven by a servo driving motor for supplying hydraulic fluid to the injection cylinder in two directions;

a hydraulic circuit for driving the injection cylinder by controlling supply of hydraulic fluid from the two-way hydraulic pump to the injection cylinder and discharge of hydraulic fluid from the injection cylinder which proceeds in accordance with movement of a piston of the injection cylinder; and a hydraulic controller for controlling rotational speed of the servo driving motor associated with the two-way hydraulic pump in injection/loading the molten metal and controlling torque of the servo driving motor in dwelling;

wherein, said piston-protruding-side hydraulic fluid pipeline being connected to a piston-protruding-side hydraulic fluid chamber of an injection cylinder;

a piston-retracting-side hydraulic fluid pipeline being connected to a piston-retracting-side hydraulic fluid chamber;

said two-way hydraulic pump being connected in between said piston-protruding-side hydraulic fluid pipeline and said piston-retracting-side hydraulic fluid pipeline;

said piston-protruding-side hydraulic fluid pipeline and piston-retracting-side hydraulic fluid pipeline are connected by a common pipeline;

a tank pipeline disposed in said common pipeline for causing hydraulic pressure to return to a hydraulic fluid tank and for causing hydraulic fluid to be suctioned from said hydraulic fluid tank;

a check/one-way valve disposed on a piston-protruding-side hydraulic fluid pipeline side section of said common pipeline; and a check valve disposed on said piston-retracting-side hydraulic fluid pipeline side section of said common pipeline, said check valve inhibiting hydraulic fluid from returning in a direction of said tank pipeline.

2. The diecasting machine according to claim 1, wherein the hydraulic controller is operative to control a discharge rate of the two-way hydraulic pump based on hydraulic pressure information from a hydraulic fluid pipeline situated on a side toward which the piston is protruding.

3. A diecasting machine comprising:

an injection cylinder including a piston, said cylinder for loading molten metal into a mold cavity by injection;

a plurality of two-way hydraulic pumps, including first and second pumps, connected in parallel with each other and driven by respective servo driving motors for supplying hydraulic fluid to the injection cylinder in two directions;

said first and second pumps each having a first port, each first port connecting to an injection port of said cylinder and not to a retraction port of said cylinder;

said first and second pumps each having a second port, each second port connecting to said retraction port of said cylinder and not to said injection port of said cylinder;

a hydraulic circuit for driving the injection cylinder by controlling supply of hydraulic fluid from the two-way hydraulic pumps to the injection cylinder and discharge of hydraulic fluid from the injection cylinder for advancing or retracting said piston;

said hydraulic circuit comprising a plurality of valves, said valves consisting of a check valve and a check/one way valve; and a hydraulic controller for:

actuating, during injection/loading the molten metal, both of said two-way hydraulic pumps or one of said two-way hydraulic pumps which is larger in capacity; and actuating, during dwelling, either of said two-hydraulic pumps or one of the two-way hydraulic pumps which is smaller in capacity.

4. The diecasting machine according to claim 3, wherein the two two-way hydraulic pumps are generally equal in capacity.

5. The diecasting machine according to claim 3, wherein one of the two-way hydraulic pumps which is driven in injection/loading the molten metal is larger in capacity than the other two-way hydraulic pump which is not driven in injection/loading the molten metal.

6. The diecasting machine according to claim 3, wherein the hydraulic controller is operative to control a discharge rate of each of the two-way hydraulic pumps based on hydraulic pressure information from a hydraulic fluid pipeline situated on a side coward which the piston is protruding.

* * * * *